US005523647A

United States Patent [19]

Kawamura et al.

[11] Patent Number: 5,523,647

[45] Date of Patent: Jun. 4, 1996

[54] COLOR CATHODE RAY TUBE HAVING IMPROVED SLOT TYPE SHADOW MASK

[75] Inventors: Takao Kawamura, Chiba; Hideo Tanabe, Mobara; Yuichi Kijima, Chousei-gun, all of Japan

[73] Assignee: Hitachi, Ltd., Tokyo, Japan

[21] Appl. No.: 212,827

[22] Filed: Mar. 15, 1994

[30] Foreign Application Priority Data

Mar. 15, 1993 [JP] Japan ..... 5-053921

[51] Int. Cl.[6] ..... H01J 29/07; H01J 31/20

[52] U.S. Cl. ..... 313/407

[58] Field of Search ..... 313/402, 403, 313/407

[56] References Cited

U.S. PATENT DOCUMENTS

| | | | |
|---|---|---|---|
| 4,495,437 | 1/1985 | Kume et al. | 313/407 X |
| 4,942,332 | 7/1990 | Adler et al. | 313/403 X |
| 4,942,333 | 7/1990 | Knox | 313/407 X |
| 4,973,283 | 11/1990 | Adler et al. | 445/30 |
| 5,111,106 | 5/1992 | Kaplan et al. | 313/407 X |
| 5,218,265 | 6/1993 | Reidinger | 313/407 |

FOREIGN PATENT DOCUMENTS 0008938 1/1986 Japan .

*Primary Examiner*—Sandra L. O'Shea
*Assistant Examiner*—Ashok Patel
*Attorney, Agent, or Firm*—Antonelli, Terry, Stout & Kraus

[57] ABSTRACT

A color cathode ray tube having a slot type shadow mask and including an evacuated envelope which includes a panel with phosphors coated on an inner surface thereof, a neck containing an electron gun and a funnel connecting the panel and the neck with each other, and also including a shadow mask assembly which is suspended inside the panel, the shadow mask assembly including a mask frame and the shadow mask held on the mask frame, the shadow mask having a large number of grilles and bridges disposed at an interval for connecting adjacent grilles, the grilles and the bridges having sections which are concave in opposite directions, respectively.

10 Claims, 4 Drawing Sheets

COLOR CATHODE RAY TUBE HAVING IMPROVED SLOT TYPE SHADOW MASK

BACKGROUND OF THE INVENTION

The present invention relates to a color cathode ray tube, and more particularly to a color cathode ray tube having an improved slot type shadow mask.

The cathode ray tube presently in wide use is a so-called shadow mask type color cathode ray tube. In a shadow mask type color cathode ray tube, traveling paths of three electron beams corresponding to red, green and glue colors emitted from an electron gun are selected and controlled through the shadow mask so as to impinge only upon respective ones of phosphors of red, green and blue colors which are disposed in discrete portions on the inner surface of a panel. Generally, a shadow mask is constituted by a thin plate of iron or iron-nickel alloy having a small thermal expansion coefficient, the thin plate having electron beam passage apertures which are circular, rectangular or slits formed between a parallel array of narrow strips held together only at the ends. On the inner surface of the panel are formed phosphors in discrete portions as mentioned above and in a form corresponding to the shape of the electron beam passage apertures.

The shadow mask having circular apertures, the one having rectangular apertures and the one having slits formed between a parallel array of narrow strips held together only at the ends are here designated a dot type shadow mask, a slot type shadow mask and a grille type shadow mask, respectively.

The slot type shadow mask can also be considered to have a structure provided with bridges disposed at an interval for connecting parallel grilles of the grille type shadow mask.

In many cases, the dot type shadow mask and the slot type shadow mask have a spherical form, while the grille type shadow mask is held in a cylindrical form with tension applied between its top and bottom.

In shadow masks, the temperature thereof rises, thus causing thermal expansion, due to impingement of electron beams on the shadow mask during operation of the cathode ray tube.

Recently there has been a strong demand for a high definition display on a cathode ray tube, and with the improvement in the resolution of the display, the necessity of suppressing to a higher degree the deviation in landing positions of electron beams on the phosphor screen caused by a shift of the electron beam passage apertures due to a thermal expansion of the shadow mask has become stronger and stronger.

For diminishing the above thermal expansion, there has been used an expensive iron-nickel alloy having a small thermal expansion coefficient as a constituent material of the shadow mask, or the shadow mask has been held on a mask frame under tension.

In the case of the above-mentioned shadow mask held under tension, during the procedure of stretching a grille type shadow mask and fixing it in a cylindrical form on a frame by tensing it in the vertical direction of the mask, the grilles become easily entangled with one another, thus making it difficult to handle the shadow mask.

For solving the above-mentioned problems, it has been attempted to hold a dot type shadow mask or a slot type shadow mask on a mask frame under tension, for example as disclosed in U.S. Pat. No. 4,973,283.

In the case where a slot type shadow mask is held on a frame under the application of tension in the vertical direction of the picture display screen in accordance with the prior art, the entanglement problem of grilles does not occur because of the presence of bridges even when the shadow mask is made thin, thus making it possible to lighten the mask frame. In this case, however, a Poisson contraction, a compressive force generated according to Poisson's ratio and acting in the transverse direction, is propagated to the right and left by the bridges, so that the grilles of the shadow mask are no longer vertically rectilinear but are bent toward the center as the distance from the center increases in the transverse direction.

In the grille type and slot type shadow masks, the portion which fulfills the intrinsic function of color selection is the grille portion.

The slot type shadow mask can also be considered to have a structure provided with bridges disposed at an interval for mechanical connection of parallel grilles with one another, which structure is adopted for eliminating the drawback of the grille type shadow mask wherein the grilles get entangled with each other during fabrication of the mask, causing great inconvenience in the handling of the mask.

The grille type shadow mask is held in a cylindrical form under the application of tension in the vertical direction, while the slot type shadow mask usually has a spherical form.

In the slot type shadow mask, as the definition of the display is improved, it is possible to cope with beam landing errors due to thermal expansion by using an iron-nickel alloy having a small thermal expansion coefficient as the material of the shadow mask. However, this alloy is expensive as mentioned previously.

The slot type shadow mask is formed of iron and if it is held under vertical tension like the grille type shadow mask, there occurs an inconveniences such that the mask frame used is required to have a high rigidity and is therefore heavy.

Further, when the slot type shadow mask is held under the application of vertical tension in parallel with the grilles, a transverse compressive force generated according to Poisson's ratio is propagated to the right and left through the bridges, thus causing an inconvenience such that the grilles of the shadow mask are not vertically rectilinear but are bent toward the center of the mask as the distance from the center increases in the transverse direction. This is as noted previously.

SUMMARY OF THE INVENTION

It is the object of the present invention to solve the above-mentioned problems of the prior art and provide a color cathode ray tube having a slot type shadow mask free of bending of grilles when held under vertical tension.

In one aspect of the present invention, in order to achieve the above object, there is provided a color cathode ray tube including at least an evacuated envelope including a panel with phosphors formed on an inner surface thereof, a neck containing an electron gun and a funnel connecting the panel and the neck with each other, and a shadow mask assembly having a slot type shadow mask suspended inside the panel, the shadow mask assembly including mask frames and the shadow mask held on the mask frames the shadow mask having a large number of grilles and bridges disposed at an interval for connecting adjacent grilles, the grilles and the bridges having sections which are concave in opposite directions, respectively.

In another aspect of the present invention there is provided a color cathode ray tube including at least an evacuated envelope including a panel with phosphors formed on an inner surface thereof, a neck containing an electron gun and a funnel connecting the panel and the neck with each other, and a shadow mask assembly having a slot type shadow mask suspended inside the panel, the shadow mask assembly including mask frames and the shadow mask held on the mask frames the shadow mask having a large number of grilles and bridges disposed at an interval for connecting adjacent grilles, the grilles and the bridges having sections such as trapezoidal or semicircular sections which are concave in opposite directions, respectively.

In the grilles, the concave section thereof referred to above may be present continuously from the upper to the lower end along the grilles, or it may be present only in portions of the grilles in the vicinity of a bridge.

DESCRIPTION OF THE PREFERRED EMBODIMENTS

According to the construction of the present invention, including the portion referred to in the foregoing summary of the invention, the inconvenience that when the slot type shadow mask is held under the application of tension in the vertical direction parallel to its grilles, the mask frame is required to be enhanced in its rigidity in order to withstand the tension and therefore becomes heavy, and the inconvenience that the grilles become curved as the horizontal distance from the center of the mask increases, can be overcome by making the grille thickness smaller.

Reference is also made here to the foregoing problem that the compressive force generated according to Poisson's ratio and acting in the transverse direction is transmitted to adjacent grilles through bridges and consequently the grilles bend toward the center. For solving such a problem, the smaller the number and thickness of the bridges, the better. In the present invention, basically, the bridge thickness and also the grille thickness are made small, and the bridges and grilles have sections which are concave in opposite directions, respectively, whereby there is attained an excellent effect.

More particularly, by forming the Sections of the grilles and the bridges to be concave in opposite directions to each other, there is created a spring action against the foregoing transverse compression generated according to Poisson's ratio, whereby the bending of the grilles can be diminished.

An embodiment of the present invention will be described in detail hereinunder with reference to the accompanying drawings.

Figure 1A:
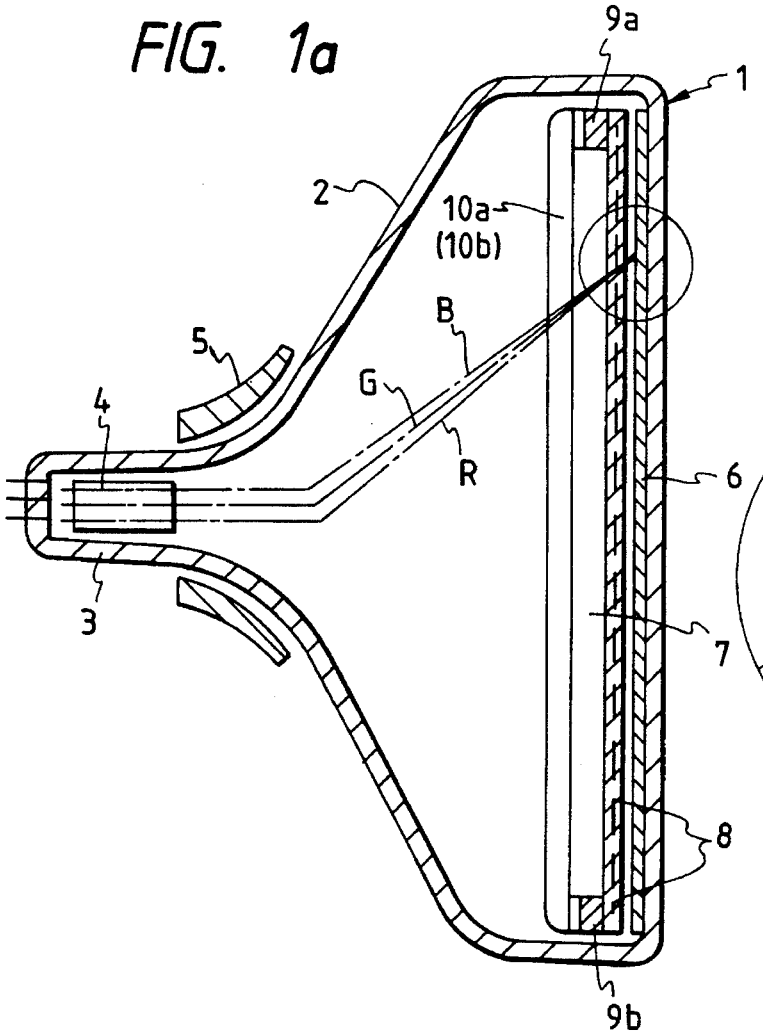
FIG. 1*a* is a schematic sectional view of a color cathode ray tube having an improved slot type shadow mask according to an embodiment of the present invention.
Figure 1B:
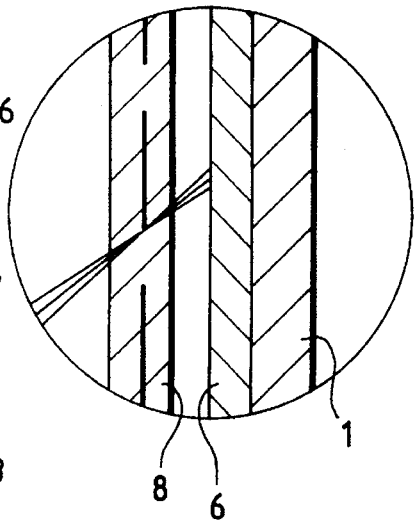

FIG. 1*a* is a schematic sectional view of a color cathoderay tube having an improved slot type shadow mask according to an embodiment of the present invention. In the same figure, the reference numeral 1 denotes a panel, numeral 2 denotes a funnel, numeral 3 denotes a neck, numeral 4 an electron gun, numeral 5 a deflection yoke, numeral 6 a phosphor screen, numeral 7 a shadow mask assembly, numeral 8 a slot type shadow mask, numerals 9*a* and 9*b* denote mask frames, and numeral 10*a* (10*b* not shown) a support frame.

In FIG. 1*a*, the shadow mask assembly 7 includes the slot type shadow mask 8 fixed under tension to the mask frames 9*a* and 9*b* which are fixed at a predetermined spacing by means of a pair of support frames 10*a* (and 10*b*).

In this construction, three electron beams R, G and B emitted from the electron gun 4 are deflected in horizontal and vertical directions by means of the deflection yoke 5, then are subjected to color selection through a slot serving as an electron beam passage aperture formed in the slot type shadow mask 8 and then impinge on predetermined phosphors which constitute the phosphor screen 6 as shown in greater detail in FIG. 1*a* which is an enlarged view of the encircled portion in FIG. 1*a*.

The electron beams R, G and B are modulated in accordance with drive signals provided to control electrodes in the electron gun, and a desired picture image is displayed according to a current ratio of the three electron beams.

The shadow mask assembly 7 is suspended by a spring suspension mechanism provided on each side wall of the panel 1.

FIG.. 2 is a perspective view of the shadow mask assembly. This shadow mask assembly 7 comprises the slot type shadow mask 8 fixed under tension to the mask frames 9*a* and 9*b* which are fixed at a predetermined spacing by the pair of support frames 10*a* and 10*b*. The slot type shadow mask 8 is fixed by welding under tension to the mask frames 9*a* and 9*b* at its vertical end portions 8*a* and 8*b*.

The tension of the slot type shadow mask 8 is borne by the support frames 10*a* and 10*b* which support the mask frames 9*a* and 9*b* at a predetermined spacing.

The slot type shadow mask 8 has bridges 8*f* connecting adjacent grilles 8*e* which are disposed in a large number and are parallel to one another in the vertical direction, the bridges 8*f* being arranged at a vertical pitch of about 0.7 to 2.5 mm.

When the shadow mask 8 is held on the mask frames 9*a* and 9*b* under tension, the grilles 8*e* extend due to the tension. At this time, a transverse compressive force which is determined by Poisson's ratio is created in the grilles and exerts a transverse extension force on the bridges 8*f* connecting the grilles 8*e*.

In this embodiment, however, since the bridges 8*f* and the grilles 8*e* have sections which are concave in opposite directions to each other, the transverse extension force is diminished by a spring action. Consequently, the degree of bending of the grilles 8e is lessened to prevent the occurrence of a landing deviation of electron beams as in the prior art.

Figure 3A:
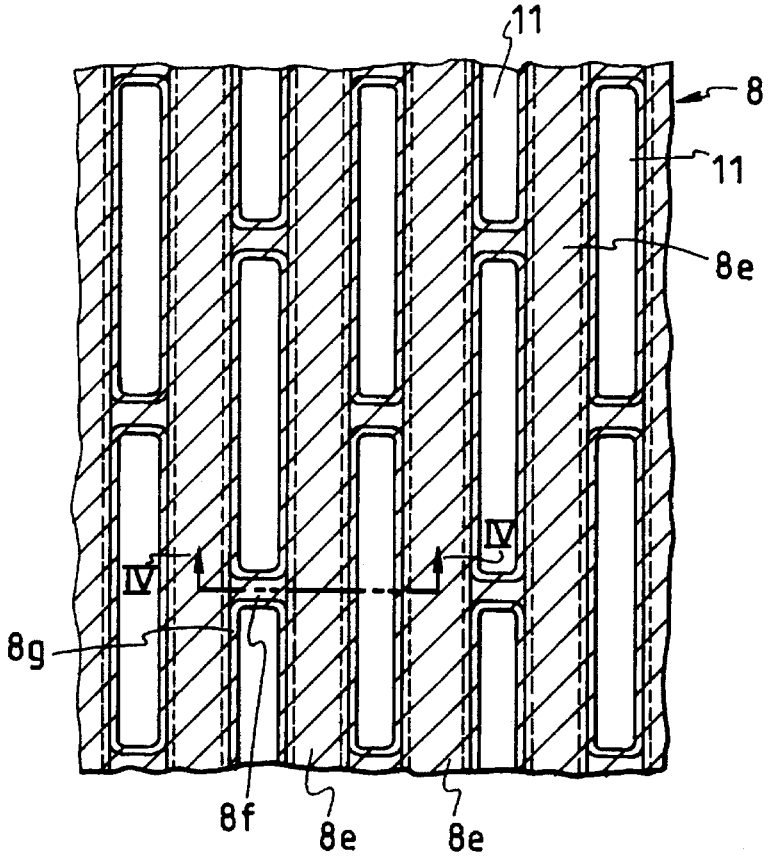
FIGS. 3*a* and 3*b* are a plan view and a perspective view, respectively, of a principal portion of an example of a shadow mask assembly to be mounted in the color cathode ray tube.
Figure 3B:
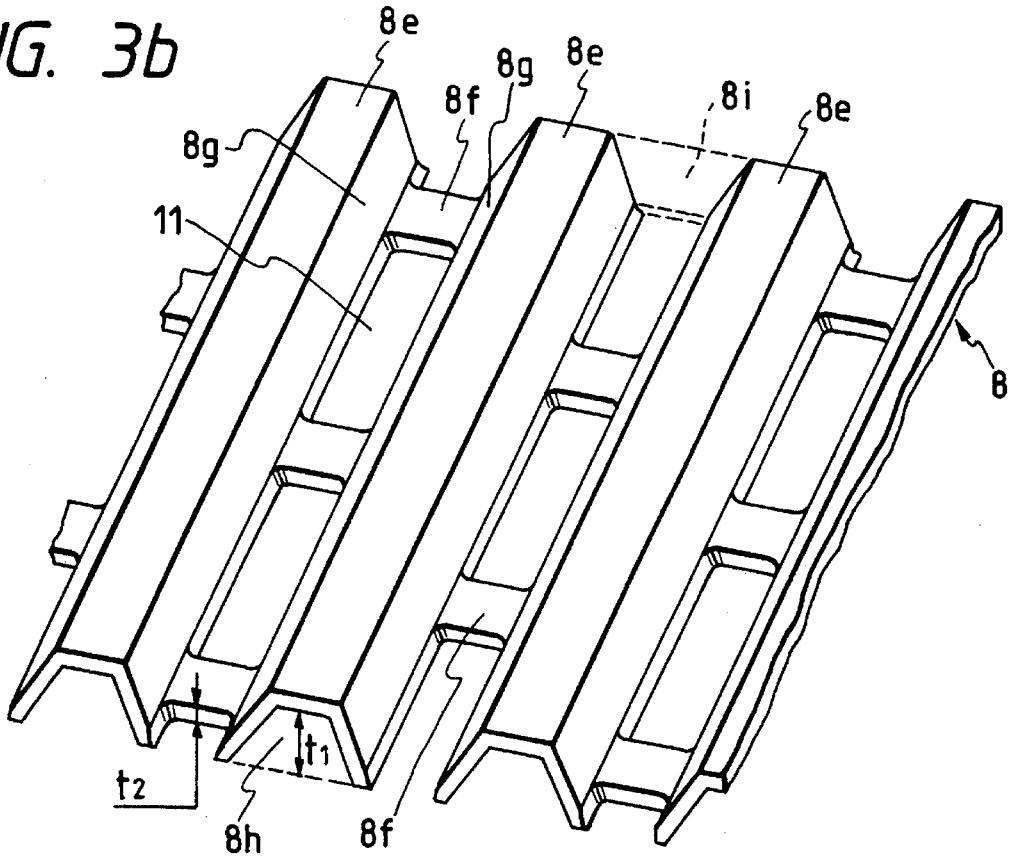
Figure 4:
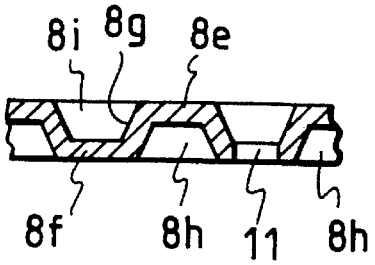
FIG. 4 is a sectional view taken along the line IV—IV in FIG. 3*a;*

FIG. 3a is a plan view of a principal portion showing an example of a shadow mask assembly mounted in the color cathode ray tube, FIG. 3b is a perspective view thereof, and FIG. 4 is a sectional view taken along the line IV—IV in FIG. 3a.

In the shadow mask assembly of this example, a large number of grilles 8e of a slot type shadow mask 8 are interconnected by bridges 8f, and a large number of slots 11 are defined by both the grilles 8e and the bridges 8f.

The thickness of the slot type shadow mask 8 is 25 μm. The grilles 8e are subjected to an etching treatment to form cavities 8h having a concave section, and the backs of the bridges 8f are also etched to form cavities 8i having a concave section.

The numeral 8g represents a connecting portion between a cavity 8h and a cavity 8i adjacent thereto. In FIG. 3b, the values of $t_1$ and $t_2$ are approximately 15 μm and 8 μm, respectively.

The width of each grille 8e on the phosphor screen side (this side of the figure) is about 0.18 mm and that on the electron gun side (the back side of the figure) is about 0.22 mm. The depth $t_1$ of the cavity of the grilles 8e is about 15 μm. As a result, the thickness of each grille 8e is decreased by about 60%.

Figure 2:
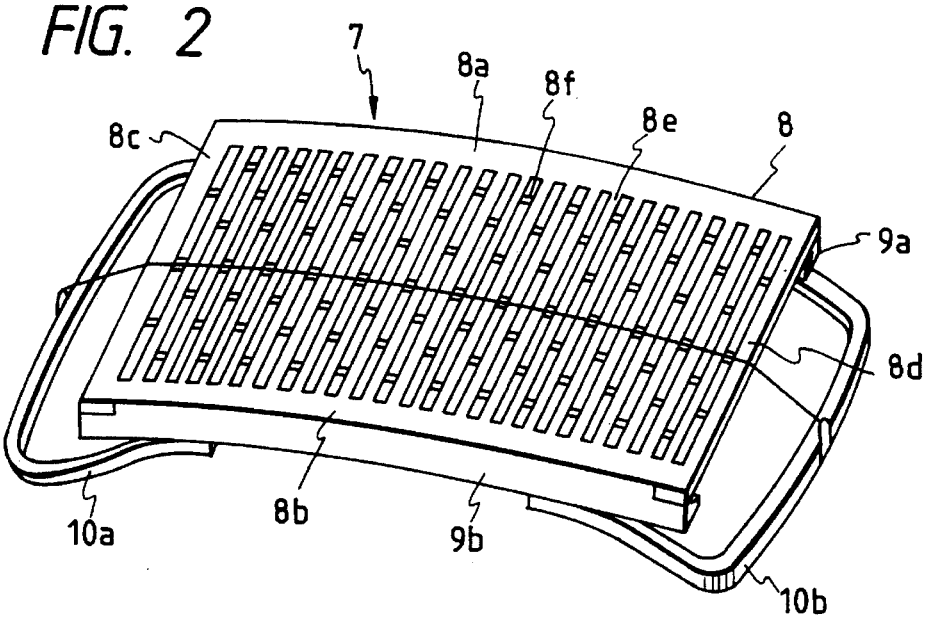
FIG. 2 is a perspective view of a shadow mask assembly to be mounted in the color cathode ray tube.

As shown in FIGS. 2 to 4, the bridges 8f connect the grilles 8e at intervals of about 1 mm, and their vertical width is about 0.08 mm and transverse width about 60 μm.

As to the thickness $t_2$ of each bridge 8f shown in FIG. 2, its value in this example is about 8 μm in the presence of the cavity 8i as in FIG. 4.

When the slot type shadow mask 8 having such a structure is held and fixed under tension through the mask frames as shown in FIG. 2, etc., a transverse compressive force which is determined by Poisson's ratio is generated in the grilles 8e and acts as a transverse extension force for pulling the bridges 8f toward adjacent grilles.

If the depth $t_1$ of the cavity of each grille 8e and the thickness $t_2$ of each bridge 8f are set so as to satisfy the condition that the former is larger than the latter, the connecting portions 8g between the cavities 8h and 8i in the grille 8e and the bridges 8f adjacent thereto, respectively, act as a spring, so that the transverse compressible force generated in the grilles 8e is absorbed by the connecting portions 8g and only a portion thereof is transmitted to the bridges 8f to thereby prevent the phenomenon that the grilles 8e are no longer linear in the vertical direction but are bent toward the center of the mask as the distance from the center increases in the transverse direction.

If the depth $t_1$ is set at a value of about 1.2 to 2.5 times as large as the thickness $t_2$, there will be obtained a good function and effect.

Figure 7:
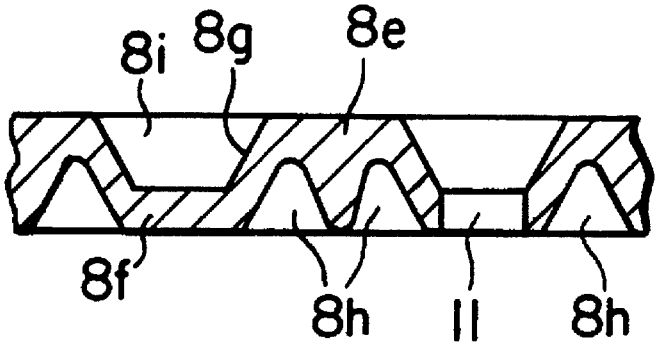
FIG. 7 is a sectional view of grilles of another embodiment of the present invention.
Figure 8:
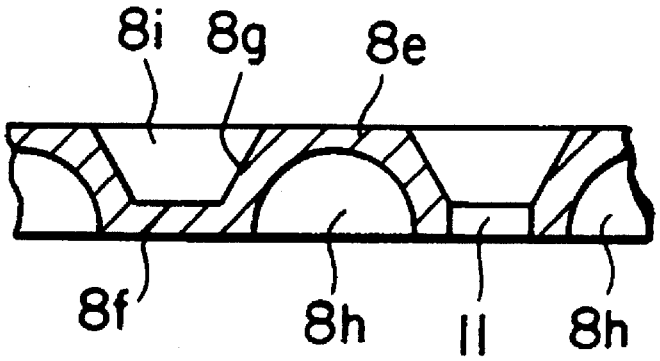
FIG. 8 is a sectional view of grilles of still another embodiment of the present invention.

Although in this example the cavity 8h in each grille 8e is formed as one groove extending in the vertical direction, it goes without saying that two or more grooves extending vertically in parallel may be formed in one grille 8e as shown in FIG. 7. As another embodiment, a concave section of grilles is semicircular as shown in FIG. 8.

Further, the outermost grilles 8c and 8d may be formed wider than the other grilles to prevent the grilles 8e from being bent toward the center of the mask as the distance from the center increases in the transverse direction.

In this example, the width of each grille 8e except the outermost grilles is about 0.2 mm and that of each of the outermost grilles 8c and 8d is about 5 mm.

Thus, the outermost grilles 8c and 8d may be made wider to diminish the bending of the grilles 8e, and their outside edges in the width direction may be bent toward the electron gun to enhance a vibration resisting effect.

Figure 5:
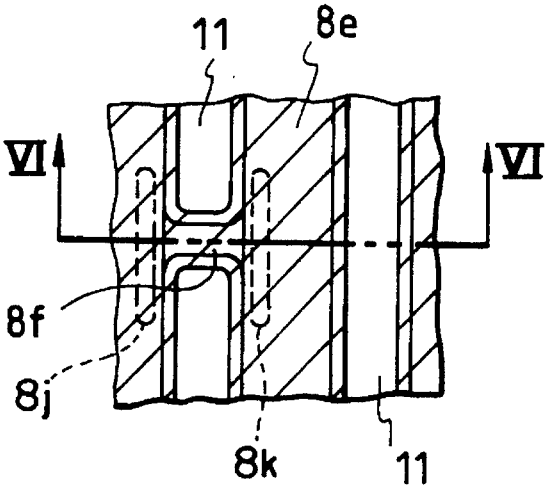
FIG. 5 is a plan view of a principal portion of another example of a shadow mask assembly to be mounted in the color cathode ray tube.
Figure 6:
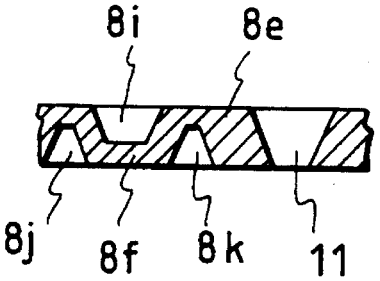
FIG. 6 is a sectional view taken along the line VI—VI in FIG. 5.

FIG. 5 is a plan view of a principal portion showing another example of a shadow mask assembly mounted in the color cathode ray tube, and FIG. 6 is a sectional view taken along the line VI—VI in FIG. 5. In these figures, the same reference numerals as in FIGS. 3a, 3b and 4 represent the same portions as in FIGS. 3a, 3b and 4, and as shown in FIGS. 5 and 6, the numerals 8j and 8k represent cavities formed in grilles 8e on both sides of a bridge 8f and on the electron gun side.

In this example, the cavities 8j and 8k are formed only in portions of the grilles 8e in vicinity of a bridge 8f in place of cavities extending continuously from the top to the bottom in the grilles 8e described above in connection with FIGS. 3a and 3b.

In this example, like in the previous example, it is possible to prevent the grilles 8e from being horizontally curved and bent toward the center as the distance from the center increases in the transverse direction, thereby prevent mislanding of the electron beams.

It goes without saying that the present invention is also applicable to a shadow mask of a color cathode ray tube of the type wherein the mask frame is bonded to the panel such as that disclosed in U.S. Pat. No. 4,973,283 which has been referred to above in the background of the invention.

Although the above description is of the case where the slot type shadow mask is fixed under tension to only the pair of mask frames 9a and 9b which are fixed at a predetermined spacing by the pair of support frames 10a and 10b, the effect of suppressing the inconvenient deformation of the shadow mask can be attained by the invention also in the case where the four sides of the slot type shadow mask are fixed to a rectangular mask frame.

According to the present invention, as set forth above, even when the electron beam passage apertures of the shadow mask are made smaller and increased in the density of their arrangement for improving the definition of the display and the current value of electron beam is increased, it is possible to use an iron sheet without using the expensive iron-nickel alloy having a small thermal expansion coefficient as the material of the shadow mask. Besides, it is possible to solve the problems of the prior art such as the entanglement of grilles during fabrication of the shadow mask and the resulting difficulty of handling the mask and the necessity of using a heavy mask frame. Thus, it is possible to provide a color cathode ray tube using a slot type shadow mask having such superior functions.

What is claimed is:

1. A color cathode ray tube including at least an evacuated envelope comprising a panel with phosphors coated on an inner surface thereof, a neck containing an electron gun and a funnel connecting the panel and the neck with each other, and a shadow mask assembly having a slot type shadow mask suspended inside the panel, said shadow mask assembly comprising a mask frame and the shadow mask held under tension on said mask frame, said shadow mask having a multitude of grilles and bridges disposed at an interval for connecting adjacent said grilles, said grilles having sections concave toward said electron gun and said bridges connecting edges of said concave sections of said grilles on a side of the electron gun.

2. A color cathode ray tube according to claim 1, wherein said concave sections are at least partially trapezoidal.

3. A color cathode ray tube according to claim 1, wherein said concave sections are semicircular.

4. A color cathode ray tube according to claim 1, wherein said concave sections include a plurality of grooves extending in parallel in a longitudinal direction of said grilles.

5. A color cathode ray tube according to claim 1, wherein there is the relation of $t_1>t_2$ between a depth, $t_1$, of said concave section of each said grille and a thickness, $t_2$, of each said bridge.

6. A color cathode ray tube according to claim 2, wherein there is the relation of $t_1>t_2$ between a depth, $t_1$, of said concave section of each said grille and a thickness, $t_2$, of each said bridge.

7. A color cathode ray tube according to claim 3, wherein there is the relation of $t_1>t_2$ between a depth, $t_1$, of said concave section of each said grille and a thickness, $t_2$, of each said bridge.

8. A color cathode ray tube according to any of claims 1 to 7, wherein a depth, $t_1$, of said concave section of each said grille is 1.2 to 2.5 times as large as a thickness, $t_2$, of each said bridge.

9. A color cathode ray tube including at least an evacuated envelope comprising a panel with phosphors coated on an inner surface thereof, a neck containing an electron gun and a funnel connecting the panel and the neck with each other, and a shadow mask assembly having a slot type shadow mask suspended inside the panel, said shadow mask assembly comprising a mask frame and the shadow mask held under tension on said mask frame, said shadow mask having a multitude of grilles and bridges disposed at an interval for connecting adjacent said grilles, a cavity being formed in portions of said grilles in the vicinity of the bridge adjacent thereto so that said grilles have a section concave toward said electron gun.

10. A color cathode ray tube according to claim 1 to 9, wherein all of said bridges connecting adjacent said grilles lie substantially in a same plane on a side of said electron gun.

* * * * *